United States Patent [19]

Bundschuh et al.

[11] 4,279,048

[45] Jul. 21, 1981

[54] HEEL ASSEMBLY FOR WATER SKI BINDER

[75] Inventors: Robert Bundschuh, Miami Lakes; George Thorne, Fort Lauderdale; David Cottis, Winter Haven, all of Fla.

[73] Assignee: Cypress Gardens Skis, Cypress Gardens, Fla.

[21] Appl. No.: 118,900

[22] Filed: Feb. 6, 1980

[51] Int. Cl.[3] ..... A63C 9/12

[52] U.S. Cl. ..... 9/310 AA; 280/633

[58] Field of Search ..... 9/310 AA; 280/628, 633

[56] References Cited

U.S. PATENT DOCUMENTS

| | | | |
|---|---|---|---|
| 2,382,149 | 8/1945 | Hartman | 9/310 |
| 2,866,210 | 12/1958 | Romig | 9/310 |
| 2,970,325 | 2/1961 | Moline et al. | 9/310 |
| 3,088,138 | 5/1963 | Martin | 9/310 |
| 3,103,672 | 9/1963 | Lockwood | 9/310 AA |
| 3,137,014 | 6/1964 | Meucci | 9/310 |
| 3,176,328 | 4/1965 | Wallberg et al. | 9/310 |
| 3,231,911 | 2/1966 | Clifton | 9/310 |
| 3,254,352 | 6/1966 | Lockwood | 9/310 AA |
| 3,731,328 | 5/1973 | Russell | 9/310 |
| 4,131,963 | 1/1979 | Johnson | 9/310 |

*Primary Examiner*—William A. Cuchlinski, Jr.
*Attorney, Agent, or Firm*—Dowell & Dowell

[57] ABSTRACT

An adjustable heel assembly for a water ski binder in which the component parts of the heel assembly are united in functional relationship relative to one another without the aid of additional mechanical fasteners. An elastomeric heel member is cooperatively interlocked to a base member which is slidably and adjustably disposed between a pair of side rails. The base member is adjustably connected to the side rails by a selectively operated lock mechanism carried by the base member. The heel assembly and the side rails are spaced from the ski so as to allow fluid to flow between the components of the heel assembly and the surface of the ski and thereby prevent the buildup of debris therein.

10 Claims, 8 Drawing Figures

10
11
12
13
14
15
16
17
18
19
20
24
26
28
29
30
31
41
45
48
56
57
60
61
72
73
80

4
5
10
12
13
15
16
17
18
19
24
26
28
29
30
31
37
40
45
46
47
48
49
56
57
59
60
61
73
80

HEEL ASSEMBLY FOR WATER SKI BINDER

BACKGROUND OF THE INVENTION

SUBJECT MATTER OF THE INVENTION

This invention is directed generally to water ski binders and is directed specifically to a heel assembly for a water ski binder in which the component members of the heel assembly are adapted to be assembled in interlocking relationship with one another without the aid of separate mechanical fasteners and in which the heel carrying base portion of the heel assembly is adjustably and slidably disposed between a pair of opposed guide or side rails and selectively interlocked therewith by a locking apparatus which is controlled by a push button mechanism and which provides for a quick release of the locking mechanism from both side rails in a single one-handed manipulation of the push button.

SUMMARY OF THE INVENTION

The present invention is embodied in a heel assembly for a water ski binder including a heel member, a base portion or member, a locking member, and side rail members which are brought into functional and interlocking engagement with one another without the aid of separate mechanical fasteners. The heel member of the adjustable heel assembly includes a pair of enlarged outer flange portions which are cooperatively received in a pair of elongated channels disposed along a portion of the adjustable base member and further includes apertures therethrough which are cooperatively received about a pair of depending lug members carried by the base member.

To further secure the heel member to the base member, the flanges of the heel member may be provided with depending lug members which are cooperatively received in openings through the bottom of the channel members of the base member to thereby prevent further lateral displacement of the flange portion of the heel member relative to the channel members of the base member. The base member of the heel assembly is slidably longitudinally adjusted between a pair of opposing side rails and is selectively and adjustably locked to ratchet-like teeth on the side rails by means of a spring which is operatively manipulated by a single release button.

The release button is of a configuration to protrude from the rear portion of the base member and includes a forward portion which is positively guided so as to contact the center of the locking spring which is carried by the base member and which extends outwardly at each side thereof into selective engagement with the serrated ratchet-like teeth of the side rails. An upstanding flange member is provided along the upper surface of the base member for selective engagement by the user of the heel assembly so as to provide a mechanical advantage when an appendage of the user's hand is brought into contact with the push button which is disposed in linear relationship therewith.

The heel assembly is mounted on a ski in a manner to provide a flow-through passageway so that water flushes any debris from the apparatus during use.

It is the primary object of this invention to provide a heel assembly for a water ski binder in which the component parts thereof may be quickly and easily assembled in interlocking relationship with one another without the need of separate mechanical fasteners.

It is a further object of this invention to provide a heel assembly for a water ski binder in which the base portion thereof is adjustably and slidably received between a pair of side rails and is so designed and spaced from the surface of the ski to which the heel section is attached to allow liquid flowing across the ski to flush debris from the components of the assembly.

It is a further object of this invention to provide a quick release locking mechanism for a heel assembly for a water ski binder in which the base plate of the heel assembly is selectively secured in a double locking engagement with each of the opposed side rails and is selectively released from such engagement by a one-hand operational control.

It is another object of this invention to provide a locking mechanism for a water ski binder having a single push button which is positively oriented and guided with respect to an elongated locking spring in such a manner that such locking release button can be operatively brought into engagement with the elongated spring member to thereby deflect the spring member withdrawing its end portions from engagement with the side rails of the heel assembly of the binder with a single inward motion, and when the push button is released, the spring member automatically returns the push button to inoperative position.

It is another object of this invention to provide a heel assembly for a water ski binder which may be formed from a number of cooperatively interlocking molded plastic members and flexible members which are assembled relative to one another by cooperatively interlocking channels and lugs and which therefore do not require the use of extraneous mechanical fasteners.

DESCRIPTION OF THE PREFERRED EMBODIMENT

Figure 1:
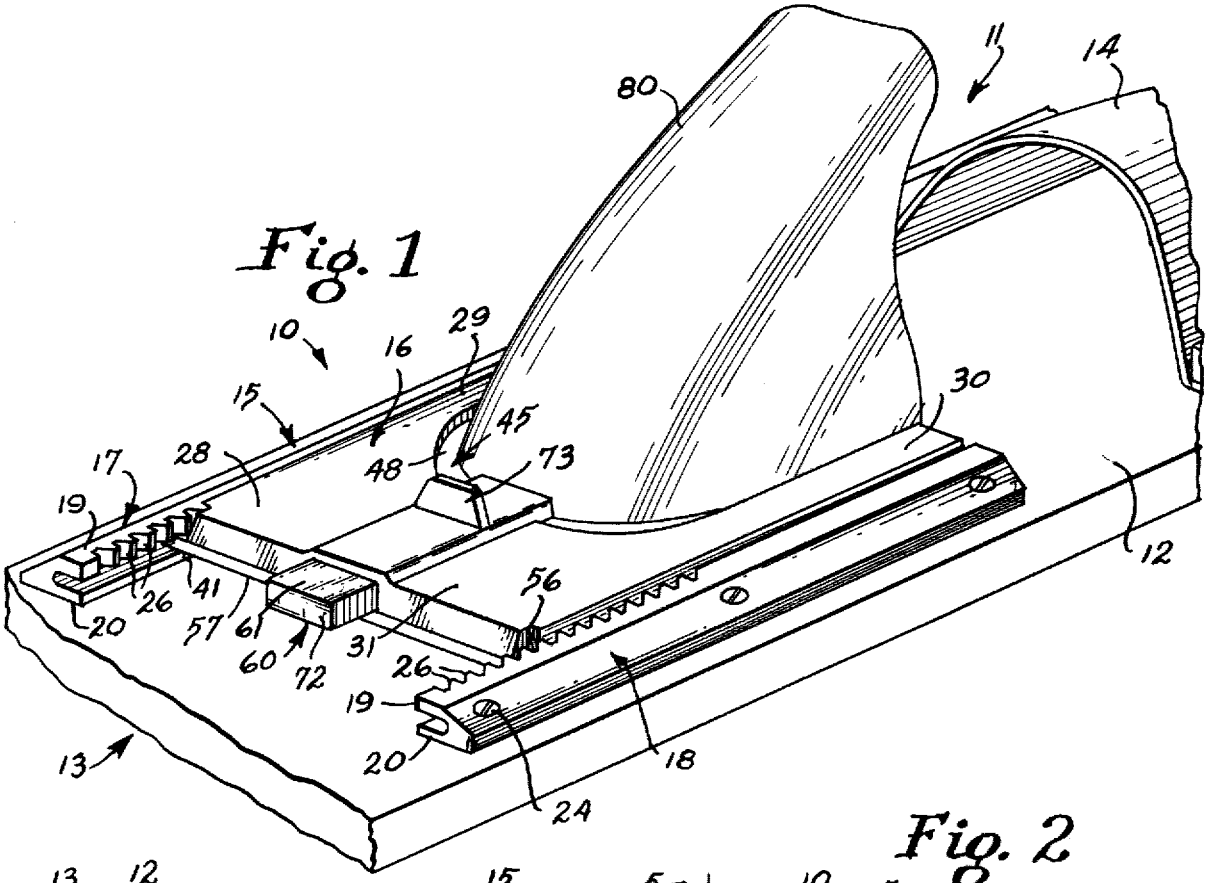
FIG. 1 is a perspective view illustrating one application of the invention.
Figure 2:
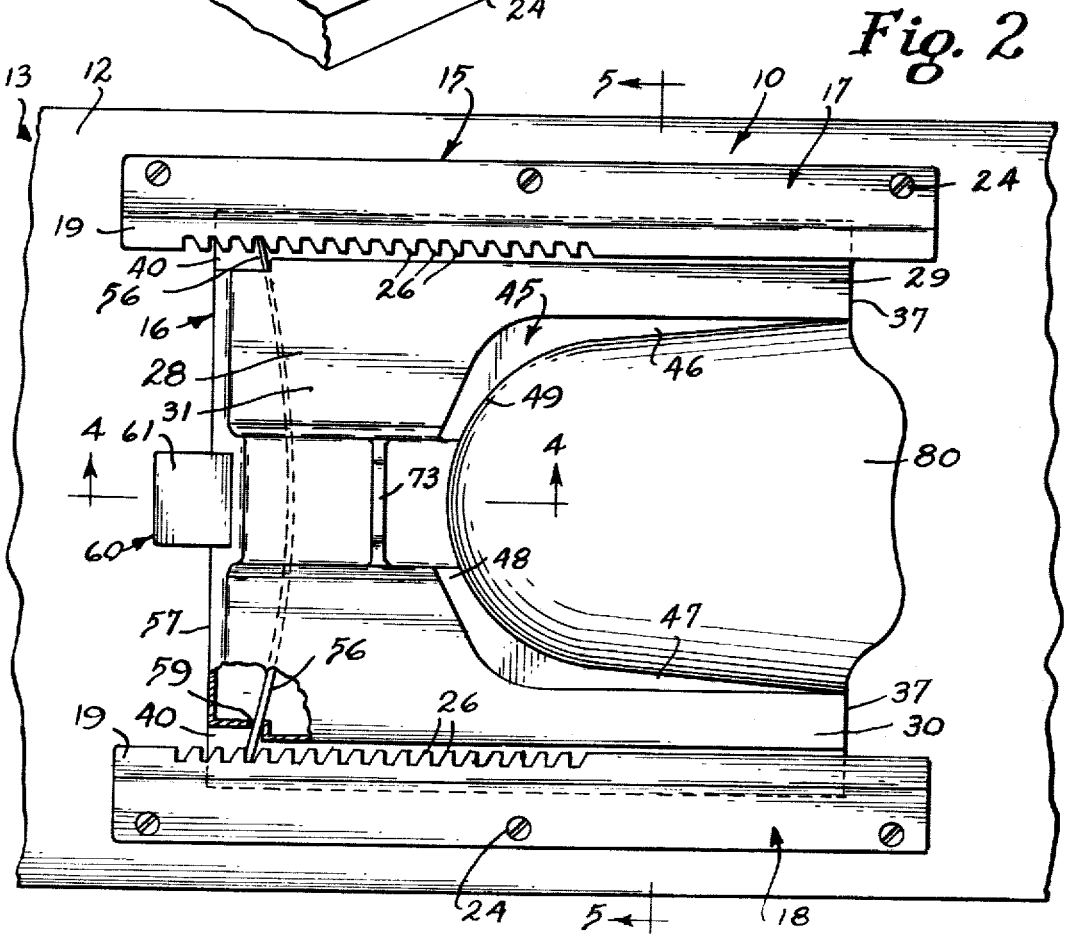
FIG. 2 is a top plan view of the heel assembly per se.

With continued reference to the drawings, the heel assembly 10 of the binder 11 is depicted as it would be attached to the upper surface 12 of a water ski 13. The heel assembly is mounted along the upper surface of the water ski so as to be positioned relatively rearwardly of the toe hood 14 of the binder 11 and is adjustably mounted so as to alter the size of the binder to accommodate a wide range of foot sizes.

With particular reference to FIG. 1, the heel assembly 10 of the binder 11 includes a heel member 15, a base member or portion 16 and a pair of elongated side rails 17 and 18, respectively. The side rails 17 and 18 are disposed in spaced opposed relationship to one another on the upper surface of the ski and slidably receive the base portion 16, as will be hereafter described in further detail. Each of the side rails 17 and 18 includes an upper portion 19 and a lower portion 20 having an elongated open channel 21 formed therebetween. A plurality of apertures or openings 23 are provided through each of the side rails 17 and 18 through which screws or other fastening means 24 may be selectively received to mechanically secure each side rail to the upper surface of the ski.

In order to space each side rail relative to the upper surface of the ski, mounting bosses 25 are provided around each of the openings 23 along the lower portion of the side rails. Such bosses extend outwardly from the lower surface of each rail and thereby space the rails from the upper surface of the ski when the rails are secured by the fasteners 24. Each side rail includes a plurality of teeth 26 along at least a portion of the upper portion of each of the side rails and the teeth of one rail are in facing relationship with the teeth of the other rail. It should be noted that the teeth 26 are inclined so as to be directed slightly toward the toe hood or front of the ski for reasons as will be hereinafter discussed. The base member or portion 16 is bifurcated or generally U-shaped having a generally rectangular bight portion 28 and forwardly extending hollow leg members 29 and 30. Such base portion has an upper wall 31, lower wall 32, and side walls 33. Each of the hollow leg members 29 and 30 is provided with an elongated inwardly facing slot 34 so that such leg members define generally box-like C-shaped channels 35 and 36 which are in opposed facing relationship. The channels 35 and 36 extend from the forward open end tip 37 of each leg member 29 and 30 to a position adjacent to the rectangular bight portion 28.

The base member 16 includes elongated outwardly extending flange members 40 which extend along the entire length of each side of the base member and are selectively receivable within the channels 21 of the side rails 17 and 18. A pair of generally parallel elongated base guide flanges or rails 41 and 42 are provided which extend downwardly from the lower wall 32 of the base member 16. It should be noted that each of the elongated rails 41 and 42 is spaced inwardly from the outermost portion of the flanges 40 and the distance between such rails determines the relative spacing of the side rails 17 and 18 in which the base member or portion 16 is slidably received.

Figure 5:
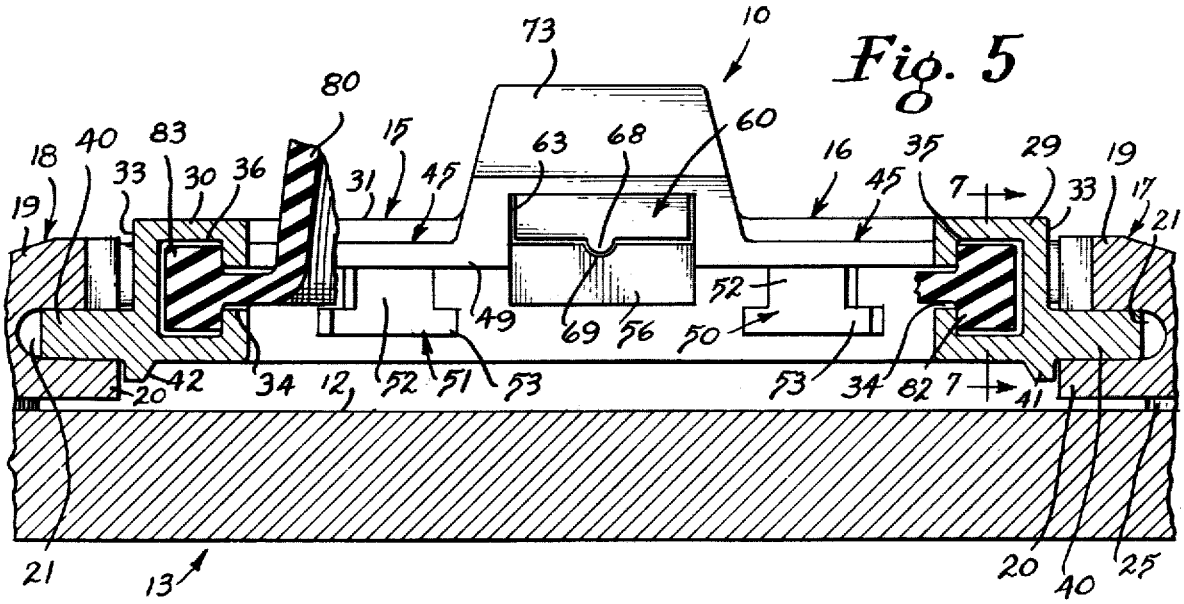
FIG. 5 is an enlarged sectional view taken along the line 5—5 of FIG. 2.

With particular reference to FIG. 5, it is noted that the rails 41 and 42 extend downwardly adjacent to the respective lower portion of each of the side rails 17 and 18 and in this manner prevent the base portion from rotational displacement relative to the side rails. Such side rails 41 and 42 need not be in intimate engagement with the lower portion of the respective side rails 17 and 18 and only need be relatively situated adjacent thereto by a distance sufficient to permit easy longitudinal or axial adjustment of the base member relative to the side rails while simultaneously preventing any undesirable rotational or lateral movement of the base member within the side rails.

If desired, a generally arcuate shaped wall or stepped portion 45 may be provided in the upper wall 31 of the base member 16 which extends inwardly from each of the leg members 29 and 30. The arcuate wall or step includes spaced flange members 46 and 47 extending from its base portion 48, adjacent the rectangular portion 28 of the base 16, to adjacent each tip 37 of the spaced leg members 29 and 30 and thereby defines a wall 49 which is of a configuration to cooperatively engage the heel member 15, as will be hereinafter described.

In order to provide means for attaching the heel member 15 to the base portion 16, a pair of heel retention lugs 50 and 51 extend downwardly in spaced relationship from the lower surface of the upper wall 31. Each heel retention lug is generally T-shaped having a stem portion 52 and an enlarged head 53.

Further, an opening 54 is provided through the lower surface of each of the leg members 29 and 30 of the base member 16 adjacent the tip 37. Such openings communicate through the lower surfaces of such leg members with each of the heel guide channels 35 and 36.

Figure 6:
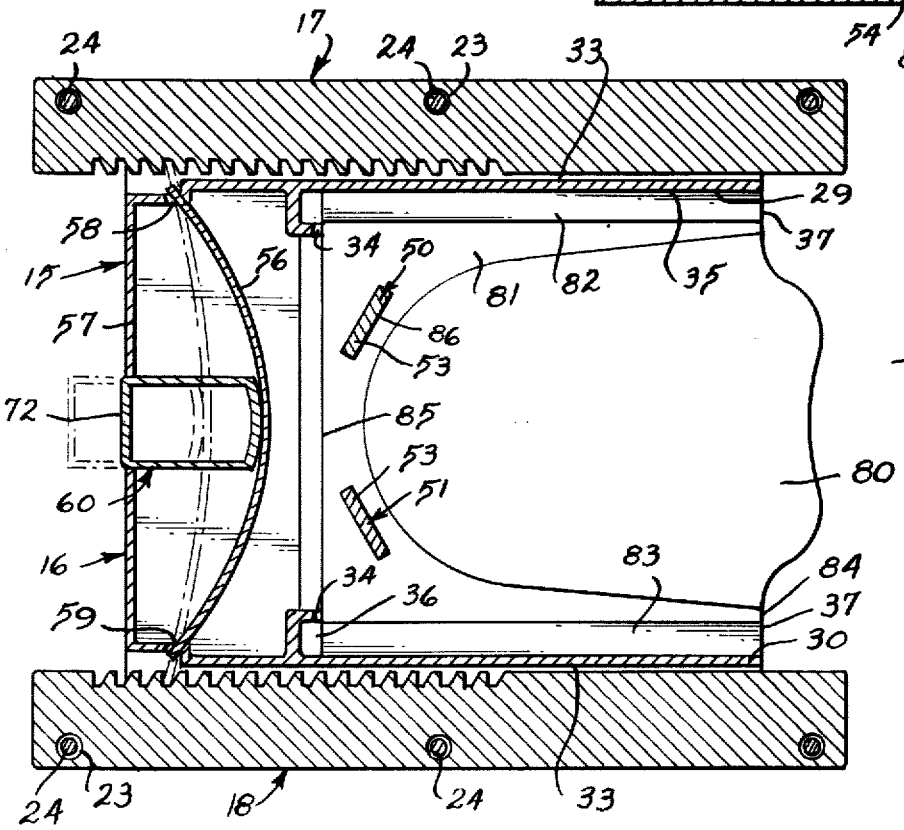
FIG. 6 is a sectional view taken along the line 6—6 of FIG. 3.

In order to selectively lock the base member 16 into engagement with the side rails 17 and 18, a single elongated flat leaf spring 56 is disposed adjacent the rear 57 of the base member 16 and between the upper wall 31 and the lower wall 32 thereof. The spring is mounted so as to extend outwardly through openings 58 and 59 through each of the side walls 33 of the base member 16. With particular reference to FIG. 6, the length of the leaf spring is shown as being slightly greater than the spacing between the opposed serrated teeth 26 of the opposing side rails 17 and 18. Therefore, when the spring is in assembled relationship within the base member and contacting the opposing serrated teeth of the side rails 17 and 18, a slight bowing or prestressing of the spring is created.

Figure 4:
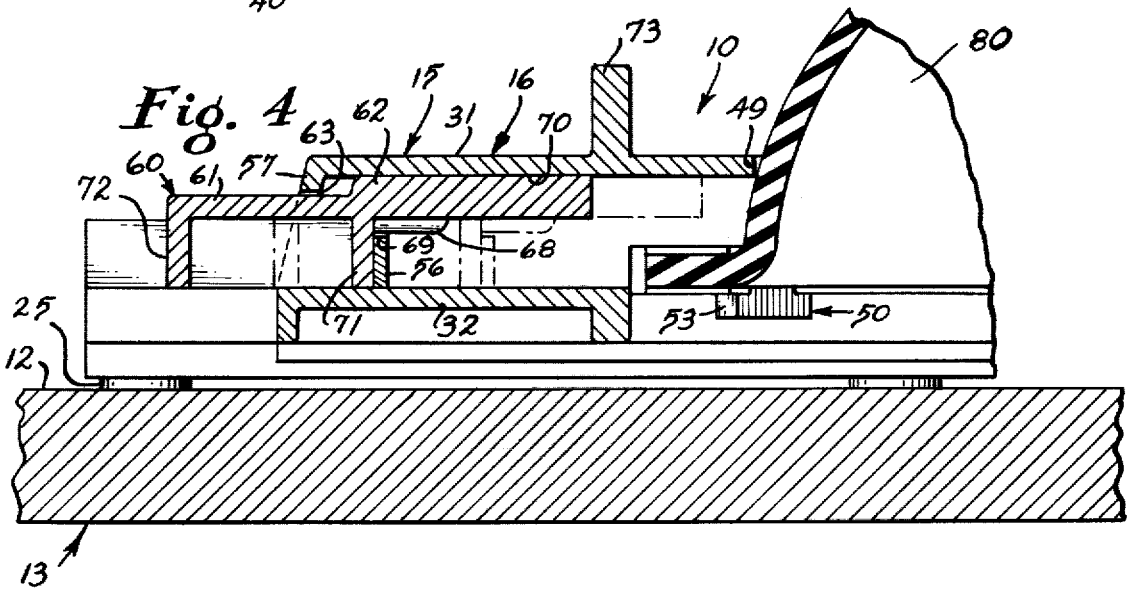
FIG. 4 is an enlarged sectional view taken along the line 4—4 of FIG. 2.

With reference to FIG. 4, in order to release or withdraw the ends of the locking spring from engagement with the teeth 26 of the side rails 17 and 18, a push button release member 60 is provided. The push button release member includes an upper wall 61 having an upwardly offset portion 62. The release member is slidably carried within a bore or passageway 63 which is provided through and generally centrally of the rectangular portion of the base member. To prevent the leaf spring from being displaced laterally of the base during assembly and manipulation or bending thereof by the release member, the underside of the offset portion includes a ridge 68 which is cooperatively received within a groove 69 provided in the central portion of the leaf spring. Due to this overlapping relationship of the offset portion of the release member with the leaf spring, the upper wall 70 of the passageway 63 is disposed slightly above the remaining portions of the upper wall 31 of the base member.

As previously noted, the release member is slidably received within the bore 63. When assembled within the bore, the front wall 71 of the release member is in engagement with the leaf spring 56 and the rear wall 72 thereof is urged outwardly from the bore due to the prestressing of the leaf spring. The rear wall 72 provides a surface against which a person may apply pressure to the release member so as to deflect the leaf spring forwardly (as shown in the dotted line position in FIG. 4) and thereby cause the ends of the leaf spring to be withdrawn from their engaged locking position with the serrated teeth of the side rails. Once the ends of the leaf spring are withdrawn from the side rails, the base member 16 may be moved or adjusted longitudinally between the side rails. As the spring locking member is prestressed, when the desired adjustment of the base member is achieved, the button is released and thereafter the rear portion of the button will automatically be moved or extended outwardly of the bore to its normal position and the ends of the spring member 56 will extend outwardly into engagement with the teeth 26 of the side rails 17 and 18. When the base member 16 is removed from the side rails 17 and 18, the rear wall 57 of the base member engages the offset portion 62 of the push button release member and functions as a stop to retain such members in assembled relationship.

A vertical tap 73 is provided which is integrally connected to and extends upwardly from the upper wall 70 above the passageway 63. The flange 73 may be grasped by a person adjusting the heel assembly in order to initiate a squeezing action to urge the release button forwardly.

Figure 8:
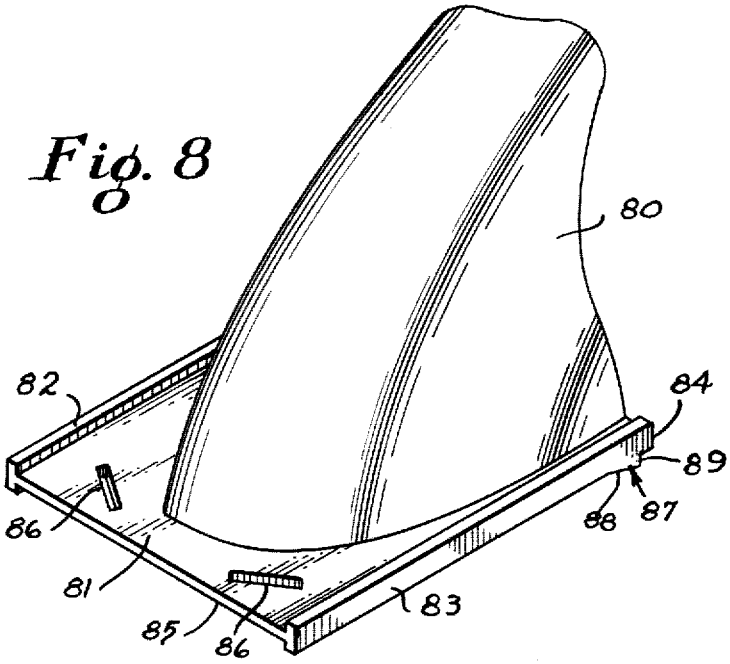
FIG. 8 is a perspective view of the flexible heel member per se.

With particular reference to FIG. 8 of the drawings, the heel member 15 is shown in greater detail. The heel member is a single or integrally molded member formed of an elastomeric material so that it may be easily shaped to conform to the contour of a human heel. The heel member includes an upstanding heel-engaging portion 80, heel base 81 and a pair of enlarged edge portions 82 and 83. The base 81 has a thickness which is less than the width of the slots 34 in the leg members 29 and 30. The enlarged edge portions extend along either side of the heel member from the front 84 thereof to the rear 85 thereof. The edge portions 82 and 83 are shown as being generally rectangular in cross-section and are of a cross-sectional dimension which is substantially larger than the width of the slots 34 and are of a size to be cooperatively received within the channels 35 and 36, respectively. The interfitting engagement of the enlarged edge portions 82 and 83 of the heel member 15 will prevent any transverse displacement of the heel member relative to the base member 16.

In order to secure the heel member 15 in fixed assembled position relative to the base portion 16, the heel base 81 is provided with a pair of slots or openings 86 which are located adjacent to the rear of the heel-engaging portion 80. The slots 86 permit the heel retention lugs 50 and 51 of the base member to be frictionally inserted therethrough and engaged therewith by a stretch fit type action so that the enlarged head 53 of each of the lugs prevents displacement of the heel member from the lugs 50 and 51.

Figure 7:
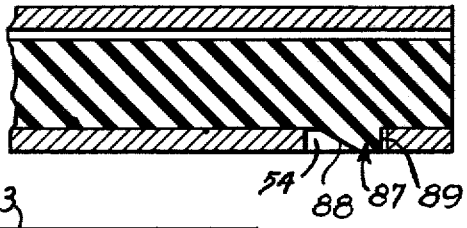
FIG. 7 is a sectional view taken along the line 7—7 of FIG. 5.

In addition to the mating engagement between the heel retention lugs and the heel member 15, such heel member is further prevented from longitudinal displacement relative to the base member 16 by a pair of downwardly extending retention tabs 87 which are provided on each enlarged edge portion 82 and 83 of the heel member. Such retention tabs are adapted to be cooperatively received within the openings 54 in channels 35 and 36, as shown in FIG. 7. Each tab 87 is formed so as to be situated adjacent the forward portion 84 of the heel member and includes a tapered rear wall 88 and perpendicular wall 89. The tapered wall 88 of the tabs 87 permits the enlarged edge portions of the heel member to be slidably inserted into the channels 35 and 36 of the base 16, while the resilient retention tabs are being compressed within the channels. When the retention tabs 87 are aligned with the openings 54, such tabs expand so that the walls 89 of the tabs prevent the heel member from being withdrawn or moved forwardly after such tabs are interlocked within the openings 54.

From the foregoing, it is apparent that the heel member 15 is securely retained within the base member 16 by a plurality of interlocking and/or interfitting engagements which jointly prevent transverse or longitudinal displacement of the heel member without requiring additional mechanical fasteners such as screws, studs, clips, rivets and the like.

Figure 3:
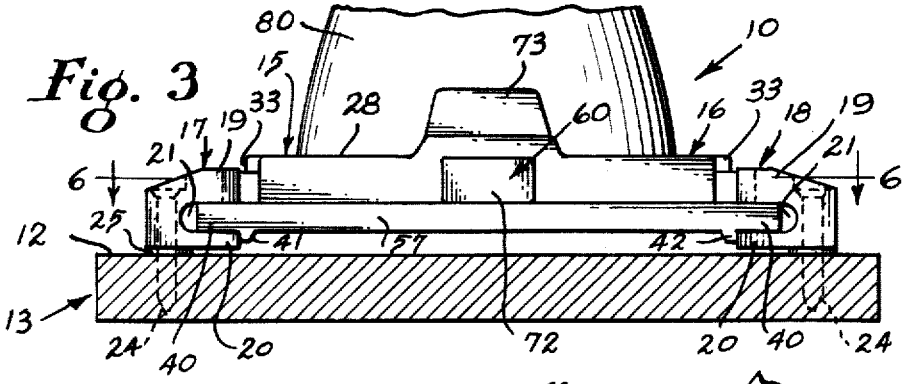
FIG. 3 is a rear elevational view thereof.

As shown in FIGS. 3 and 5, the mounting bosses 25 cause the side rails 17 and 18 and the base portion 16 to be spaced from the upper surface 12 of the ski and the grooves or channels 21 formed in the side rails extend outwardly beyond the flanges 40 of the base portion 16. In this manner, as the ski is moved through the water, such water flows freely between the heel assembly 10 and the ski, as well as through the open portion of the channels, and thereby promotes a self-cleaning action and substantially prevents any build-up of debris which may have a tendency to influence the operation of the apparatus.

The components of the heel assembly are preferably molded of a thermoplastic material of any desired color which may be either reinforced or not. Once the basic components are molded, the side rails are appropriately positioned along the upper surface of a ski and secured thereonto as previously described. The necessary components including the leaf spring, push button release member, and heel member are subsequently fitted within the base plate utilizing the integrally formed locking and mating parts of the components to retain such components in assembled relationship.

It should be noted that the enlarged edge portions 82 and 83 of the heel member 15 are slidably received within the opposing channels 35 and 36 in the base member 16 and the heel member will be urged back until the body or heel-engaging portion 80 of the heel member engages the arcuate wall 49 formed by the stepped portion 45. At this point, the retention tabs 87 of the edge portions of the heel member should be engaged in the openings 54 in the channels of the base. Subsequently, the heel base portion 81 of the heel member 15 is stretched so as to bring the slots 86 therethrough into intimate encircling engagement with the heel retention lugs 50 and 51.

The push button release member 60 is thereafter urged forwardly to withdraw the ends of the spring 56 and the base member is subsequently brought into slidable engagement with the channels 21 defined by the side rails 17 and 18 until the heel-engaging portion 80 snugly engages the heel of the skier. Once the proper foot size is obtained, the release button is allowed to return to its extended locking position which permits the ends of the leaf spring to move outwardly engaging the teeth 26 in the side rails. Due to the configuration of the teeth 26, it is possible to move the heel member 15 into engagement with the heel of the skier without operating the release member 60 since the outer ends of the spring can ride along the inclined portions of the teeth when the heel member is moved in a forward direction.

Should it become necessary at some time to replace a component of the heel assembly for any reason, it is only necessary to reverse the process discussed above for assembly. As there are no additional mechanical fasteners, such repair and replacement is greatly facilitated.

We claim:

1. A heel assembly for a water ski binder comprising a pair of opposed side rails having elongated grooves therein, a base member slidably received within said grooves of said opposed side rails, said base member being generally bifurcated having two elongated channel members with opposing slots formed therein, wall means uniting said channel members and defining an opening therebetween in said base member, at least one lug means integrally formed with said base member and extending therefrom adjacent to said opening in said base member, first locking means carried by said base member for selectively locking said base member to said side rails, a heel member having a heel-engaging portion and edge portions, said edge portions being slidably received within said open channel members of said base member so that said heel-engaging portion extends outwardly through said slots, means formed integrally with said heel member for engaging said lug means on said base member, and second locking means on each of said edge portions for interlocking with said channel members, whereby said heel member is secured to said base member without additional fastening means.

2. The invention of claim 1 in which said first locking means includes an elongated leaf spring mounted in said base member and having end portions extending outwardly on either side thereof, actuating means carried by said base member, said actuating means having a first portion disposed at least partially within said base member and having first and second walls, said first wall abutting said spring substantially intermediate said end portions thereof, means on said side rails to cooperatively receive said end portions of said spring, said spring being of a greater length than the spacing between said means on said side rails to cooperatively receive said end portions of said spring so that said leaf spring is normally retained in a prestressed bowed condition urging said second wall of said actuating means outwardly of said base member, whereby said spring is selectively withdrawn from engagement with said means on said side rail for receiving said end portion of said spring as said actuating means is moved toward said base member and said spring automatically urges said end portions outwardly from said base when said actuating mechanism is released.

3. The invention of claim 2 in which said actuating means includes means for restraining said leaf spring from lateral movement relative thereto.

4. The invention of claim 2 in which said spring means has a recess formed therein between said end portions thereof, said actuating means including a projection located adjacent to said spring, and said projection being received within said recess in said spring means, whereby said spring means is restrained from transverse movement.

5. The invention of claim 2 including a fixed tab means extending upwardly from said base member and spaced from said second wall portion of said actuating means and being in substantially axial alignment therewith, whereby said tab means may be selectively engaged as said second wall portion of said actuating mechanism is urged theretowards.

6. The invention of claim 1 in which said base member includes guide members extending downwardly from said base member adjacent and generally parallel to each of said side rails so that said base member is prevented from rotational movement relative to said side rails.

7. The invention of claim 1 in which each of said channel members includes an opening therein and said second locking means on each of said edge portions includes an outwardly extending tab which is cooperatively received within said openings in said channels.

8. The invention of claim 1 in which each of said side rails includes at least one mounting boss means for spacing said side rails above the ski so that water flows freely below said heel assembly and substantially prevents any buildup of debris.

9. In a heel assembly for a water ski binder in which the heel assembly includes a pair of opposed side rails, a base member slidably mounted between said side rails, a locking mechanism for selectively locking said base member to said side rails, and a heel member having a heel-engaging portion mounted on said base member, the improvement comprising the base having opposed hollow leg portions with slots therein, said heel member having a pair of spaced enlarged edge portions slidably receivable within said opposed leg portions of the base, each of said leg portions of the base member having an opening therein, means integrally formed on each of said enlarged edge portions for interfitting into said openings in said leg portions as said edge portions of the heel member are slidably received therein, lug means integrally formed on the base member, the heel member having means for interlocking the heel member in engagement with said lug means, whereby said heel member is cooperatively interlocked with the base member without requiring separate mechanical fasteners.

10. A heel assembly for use on a ski comprising, side rails mounted in opposed relationship along the sides of the ski, a bifurcated base member having spaced hollow leg portions with at least one opening in each leg portion, an arcuate wall connecting said leg portions and defining a generally U-shaped opening therebetween in said base member, elongated slots in each of said leg portions, said elongated slots being in facing relationship on opposite sides of said opening, locking means carried by said base member, said locking means having end portions extending outwardly from said base member and cooperatively engaging said side rails, a bore extending centrally rearwardly of the generally U-shaped opening, actuating means for said locking means slidably carried in said bore and being normally urged outwardly thereof by said locking means, a heel member having a flexible heel-engaging portion, a heel base portion and opposed enlarged edge portions, said enlarged edge portions being of a cross-section to be slidably and cooperatively receivable within said leg members so that said heel-engaging portion extends outwardly through said slots therein, said base member having heel retention lug means, said base portion of said heel member having openings which selectively and frictionally receive said lug means, and tab means integrally formed on each of said enlarged edge portions of said heel member for interfitting within said openings in said hollow leg portions of said base member.

* * * * *